US007627913B2

(12) United States Patent
Clark

(10) Patent No.: US 7,627,913 B2
(45) Date of Patent: Dec. 8, 2009

(54) TWO-PERSON HAMMOCK PROVIDING INDEPENDENT STABILITY

(76) Inventor: Gary L. Clark, 2916 Evergreen Ave., Salt Lake City, UT (US) 84109

( * ) Notice: Subject to any disclaimer, the term of this patent is extended or adjusted under 35 U.S.C. 154(b) by 0 days.

(21) Appl. No.: 12/111,704

(22) Filed: Apr. 29, 2008

(65) Prior Publication Data

US 2009/0265851 A1 Oct. 29, 2009

(51) Int. Cl.
*A45F 3/22* (2006.01)
*A45F 3/24* (2006.01)

(52) U.S. Cl. ..... 5/120; 5/122; 5/121; 5/128

(58) Field of Classification Search ..... 5/120–122, 5/128

See application file for complete search history.

(56) References Cited

U.S. PATENT DOCUMENTS

| | | | | | |
|---|---|---|---|---|---|
| 273,388 | A | * | 3/1883 | Pratt | 5/122 |
| 622,411 | A | * | 4/1899 | Black | 5/122 |
| 700,978 | A | * | 5/1902 | Palmer | 5/122 |
| 803,091 | A | * | 10/1905 | Brayshaw | 5/122 |
| 1,156,200 | A | * | 10/1915 | Ashworth et al. | 5/121 |
| 1,182,185 | A | | 5/1916 | Lysons | |
| 2,375,792 | A | | 5/1945 | Kearny | |
| 4,001,902 | A | * | 1/1977 | Hall et al. | 5/121 |
| 4,071,917 | A | | 2/1978 | Mojica | |
| 4,308,883 | A | | 1/1982 | Malone | |
| 4,320,542 | A | | 3/1982 | Cohen | |
| 5,072,465 | A | | 12/1991 | Lyons, Jr. | |
| 5,913,772 | A | | 6/1999 | Clark | |
| 6,353,946 | B1 | * | 3/2002 | Steiner | 5/121 |
| 6,364,412 | B1 | * | 4/2002 | Crawford | 297/273 |
| 7,383,597 | B2 | * | 6/2008 | Steiner | 5/121 |

OTHER PUBLICATIONS

Clark Outdoor Products Brochure: "Clark Jungle Hammock", Based on information and belief, available as early as Feb. 20, 2008.
Sky Mall Magazine, The Pawleys Island Oversided Rope Hammock, www.skymall.com, p. 28, Based on information and belief, available as early as Late Spring 2008.
"About Clark Outdoor Products", www.junglehammock.com/about.php, Feb. 13, 2008.

* cited by examiner

*Primary Examiner*—Robert G Santos
(74) *Attorney, Agent, or Firm*—Warren M. Pate, LLC

(57) ABSTRACT

A double hammock configured to accommodate two persons, while providing independent stability to both persons occupying the hammock. The hammock includes a first elongate hammock base, a second elongate hammock base, and an elongate divider member attached to both hammock bases so that the divider separates at least the head sections of the hammock bases and extends between them. Each hammock base includes a head section at one longitudinal end, a foot section at an opposite longitudinal end, an outer side section at one side between the head and foot sections, and an inner side section at an opposite side between the head and foot sections. The divider member includes a first side attached to the inner side section of the first hammock base and an opposite second side attached to the inner side section of the second hammock base.

20 Claims, 11 Drawing Sheets

TWO-PERSON HAMMOCK PROVIDING INDEPENDENT STABILITY

BACKGROUND OF THE INVENTION

1. The Field of the Invention

The present invention is directed to the field of hammocks. More particularly, the present invention is directed to a stable outdoor camping hammock designed to accommodate two persons.

2. The Relevant Technology

Existing hammock designs are not configured to support more than a single user in a stable, independent manner. For example, when putting two people into a hammock, the result is that the heavier person defines the center of gravity, often causing the other person to roll towards the heavier person, or dumping the lighter person on the ground. Even if the two people are of equal weight, the two persons will tend to roll towards one another at the center of the hammock. In addition, existing hammocks do not provide for independent "climbing in" or "climbing out", but when one person begins to move in or out of the hammock (or even shifts their weight), the changing center of gravity tends to disrupt the other person.

It would be an improvement in the art to provide a light weight double hammock that would independently and stably accommodate two persons, without any substantial disruption of one person when the other person gets into the hammock, out of the hammock, or shifts their own weight while already in the hammock.

SUMMARY OF THE PREFERRED EMBODIMENTS

The present invention is directed to a double hammock configured to accommodate two persons, while providing independent stability to both occupant positions of the hammock. The hammock includes a first elongate hammock base, a second elongate hammock base, and an elongate divider member (e.g., buffer) attached to both hammock bases so that the divider separates the hammock bases and extends between them. Each hammock base includes a head section at one longitudinal end, a foot section at an opposite longitudinal end, an outer side section at one side between the head and foot sections, and an inner side section at an opposite side between the head and foot sections. The divider member includes a first side attached to the inner side section of the first hammock base and an opposite second side attached to the inner side section of the second hammock base.

In exemplary embodiments, the double hammock may include either a three or four rope support system. Support ropes (e.g., tethers) are attached to the hammock base where fabric is gathered at the head and foot ends to provide an extremely strong connection between the rope and fabric of the hammock base. If weight is applied to the edge of a hammock base (e.g., by a person sitting on the outer edge) the hammock is able to move to align itself by forming a direct line between the two support ropes at opposite ends through the applied weight (i.e., the center of gravity). This design provides a single rope (rather than multiple ropes) associated with a given hammock base for each end, providing great stability. In a three rope system a single foot end rope may be shared by both hammock bases.

The double hammock configuration including two independent hammock bases and a divider member connecting the two bases is very stable. For example, one person may climb in or out of one of the hammock bases without upsetting or disturbing the stability of the other person. In addition, a single person may occupy one of the hammock bases on one side (or even straddle the divider) while the other side is empty. There is no tendency for one user to roll towards the center of the double hammock (towards the other user) because of the overall configuration including a support rope structure for each hammock base and the divider separating the hammock bases. Because of the support rope and divider configuration, the hammock is stable even with only a single occupant, occupying an extreme outer edge of one hammock base. In addition, a single occupant may use both hammock bases by straddling the divider, and the hammock still maintains its stability.

The divider allows the two separate hammock bases to become a single sleeping area with two independent compartments (i.e., hammock bases), while allowing the occupants to remain a comfortable distance away from one another, if desired. This is in contrast to an oversized hammock (or if two hammocks were simply sewn together with no divider), which would tend to force the occupants together in an uncomfortable way. In such a configuration it is practically impossible for the occupants to maintain a comfortable separation between them. Although there is no tendency for two occupants of the inventive hammock to roll together, they may do so if they wish, and the hammock still maintains stability. In other words, each person can roll towards the divider, causing the occupied portions of the hammock bases and divider to assume a more horizontal configuration as the hammock bases move laterally outward to cause the center of gravity of each individual to lay along a straight line between the support ropes of the occupied hammock base. This causes the inner edges of the hammock bases and the divider to stretch out under tension. In addition, the divider provides storage space which can be shared by the individual occupants (e.g., pockets may be sewn or otherwise attached to the divider member).

Because of the stability provided by the combination of the dual hammock bases, the divider, and the rope support system, in an alternative use a single occupant may position himself diagonally with the central portion of his body over the divider, which provides a nearly horizontal sleeping configuration as the hammock bases move laterally outward, and tension is applied to the divider. Such a horizontal position is desirable for hammock users.

These and other benefits, advantages and features of the present invention will become more full apparent from the following description and appended claims, or may be learned by the practice of the invention as set forth hereinafter.

BRIEF DESCRIPTION OF THE DRAWINGS

In order that the manner in which the above recited and other benefits, advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

I. Introduction

The present invention is directed to a double hammock configured to accommodate two persons, while providing independent stability to both persons occupying the hammock. The hammock includes a first elongate hammock base, a second elongate hammock base, and an elongate divider member attached to both hammock bases. Each hammock base includes a head section at one longitudinal end, a foot section at an opposite longitudinal end, an outer side section at one side between the head and foot sections, and an inner side section at an opposite side between the head and foot sections. The divider member includes a first side attached to the inner side section of the first hammock base and an opposite second side attached to the inner side section of the second hammock base so that the divider separates and extends between at least the head sections of the hammock bases.

II. Exemplary Two-Person Hammocks

FIGS. 1-6 illustrate one example of a two-person hammock 100 according to the present invention. Hammock 100 includes a first elongate hammock base 102*a*, a second elongate hammock base 102*b*, and an elongate divider member 104 attached to both hammock bases so that the divider 104 separates the hammock bases and extends between them. Each hammock base includes a head section 106*a*, 106*b* at one longitudinal end, a foot section 108*a*, 108*b* at an opposite longitudinal end, an outer side section 110*a*, 110*b* at one side between the head sections 106*a*, 106*b* and foot sections 108*a*, 108*b*, and an inner side section 112*a*, 112*b* at an opposite side between the head and foot sections. The divider member 104 includes a first side 114*a* attached to the inner side section 112*a* of the first hammock base 102*a* and an opposite second side 114*b* attached to the inner side section 112*b* of the second hammock base 102*b*.

Figure 1:
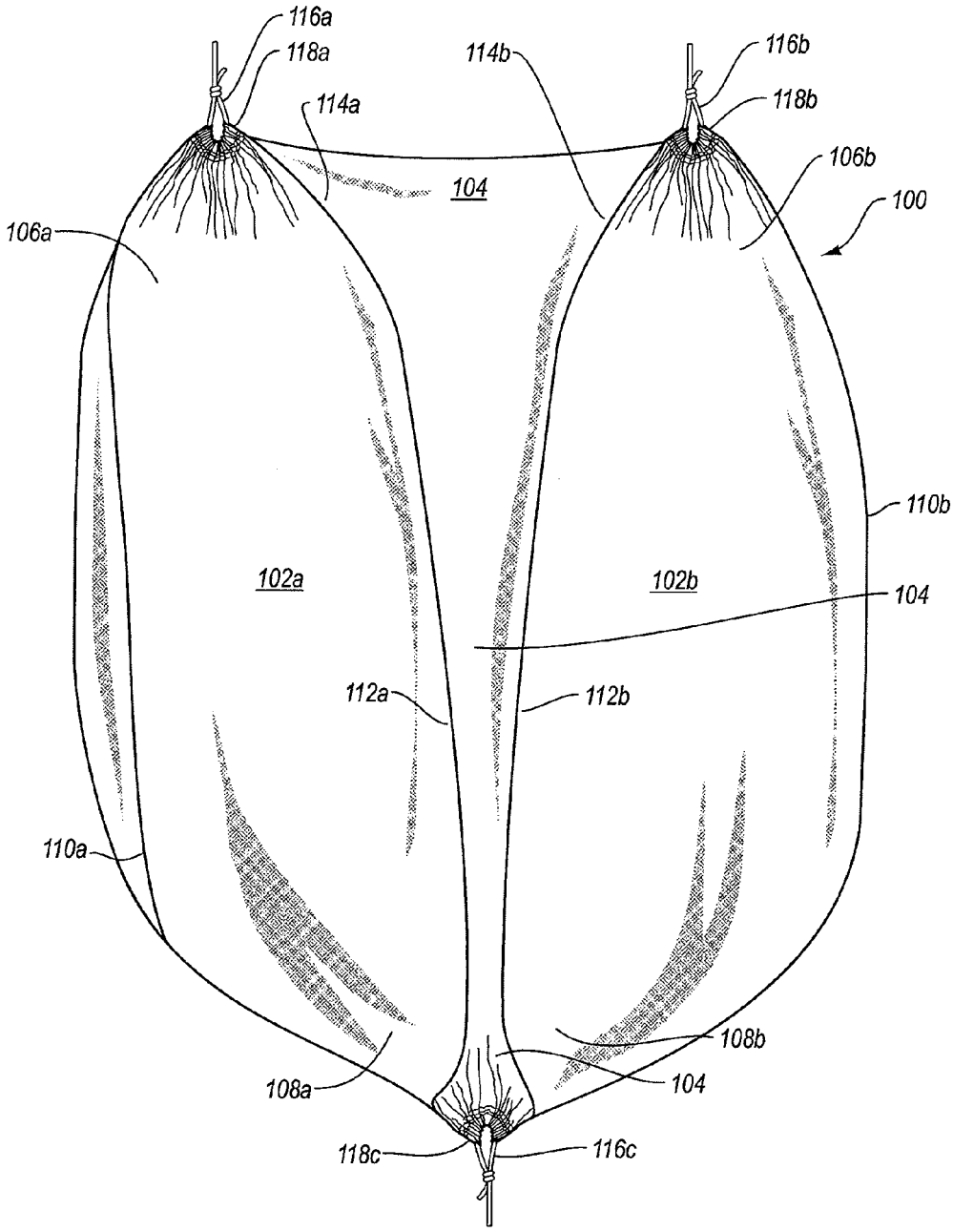
FIG. 1 is a perspective view of the two-person hammock of the present invention.

The embodiment illustrated in FIG. 1 includes a three-rope support system. Support rope 116*a* is attached to hammock base 102*a* by gathering the surrounding fabric together and attaching the rope to the fabric. For example, in the illustrated example the gathering my be accomplished though a sleeve 118*a* formed at the head end of hammock base 102*a* by folding a portion of the hammock base 102*a* back upon itself and stitching the folded over portion so as to form a sleeve 118*a*. Sleeve 118*b*, which receives support rope 116*b*, is formed in a similar manner at the head end of hammock base 102*b*. A single sleeve 118*c* for supporting both foot ends of hammock bases 102*a* and 102*b* is formed at foot end of both hammock bases 102*a* and 102*b* and divider 104. Each rope 116*a*, 116*b*, and 116*c* is attached to an upright (e.g., a tree, anchor) to support the double hammock in a stable manner that allows independent use and provides independent stability to each hammock base.

The sleeves 118*a*, 118*b*, and 118*c* are one example of how material at the head and foot ends of the hammock may be gathered together to provide an extremely strong connection between the rope and fabric of the hammock. Other similar techniques for gathering the fabric and attaching the rope will be apparent to those skilled in the art. As illustrated, it may be possible to use a single support rope 116*c* and sleeve 118*c* at the foot end of the hammock, as the width of the divider member 104 at this location may be relatively small as compared to the head end. It is for this reason that two separate support ropes 116*a* and 116*b* are provided at the head end of each hammock base, so that the divider may advantageously be of a width to provide a comfortable separation between the occupants.

Figure 2:
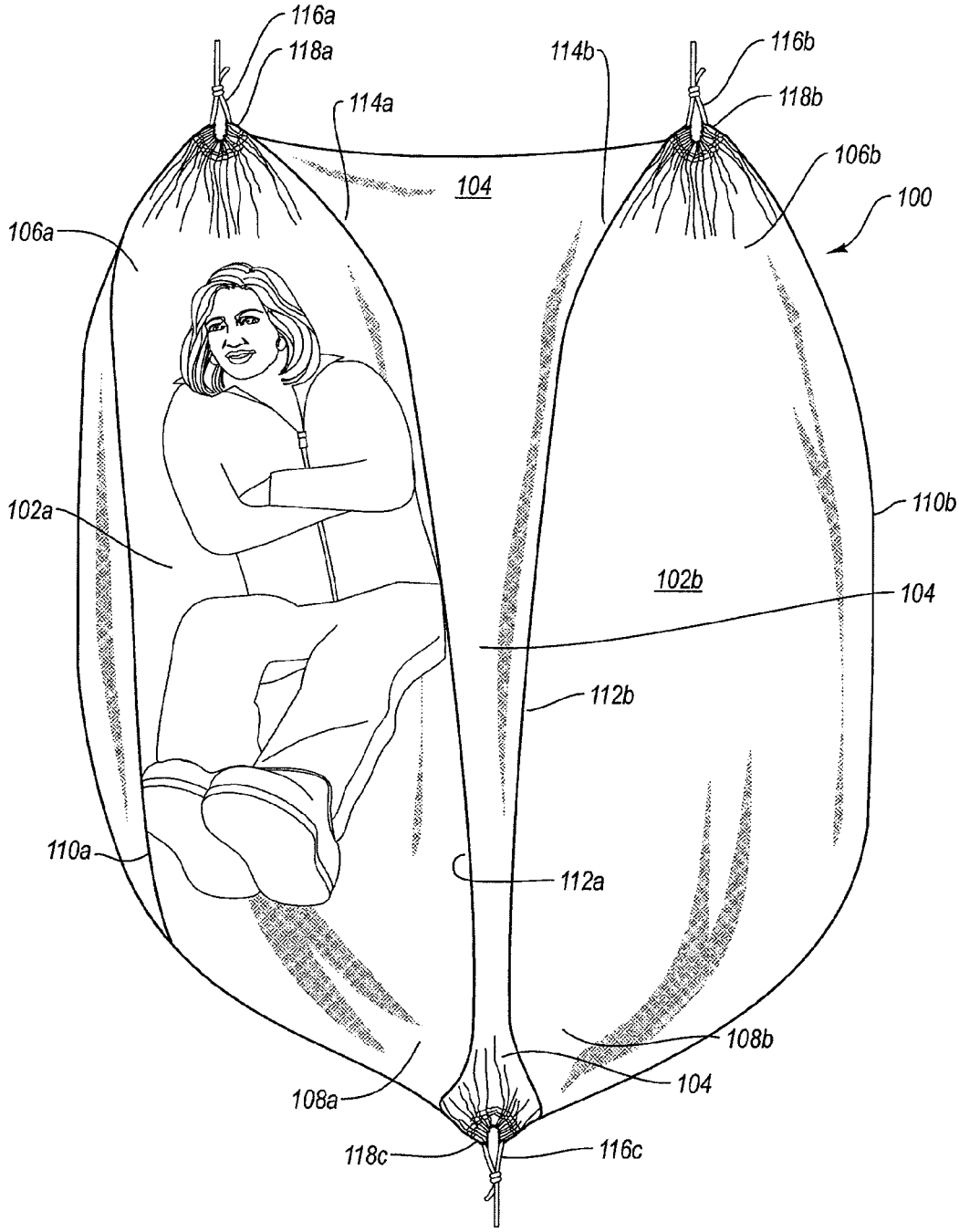
FIG. 2 illustrates the two-person hammock of FIG. 1 in which a person occupies one of the hammock bases and the other hammock base is empty.
Figure 3:
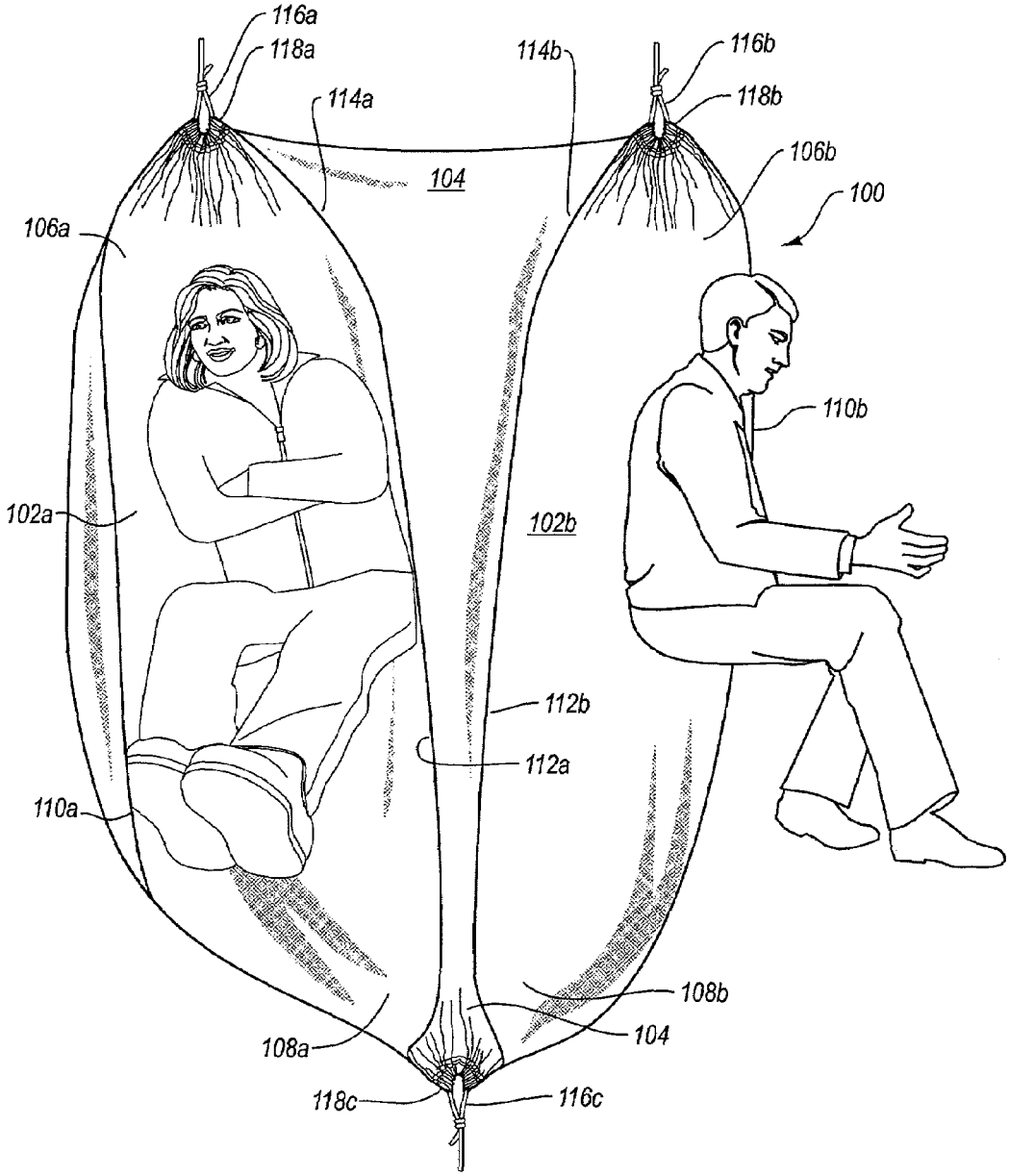
FIG. 3 illustrates the two-person hammock and occupant of FIG. 2 with a second person mounting into the second hammock base.
Figure 4:
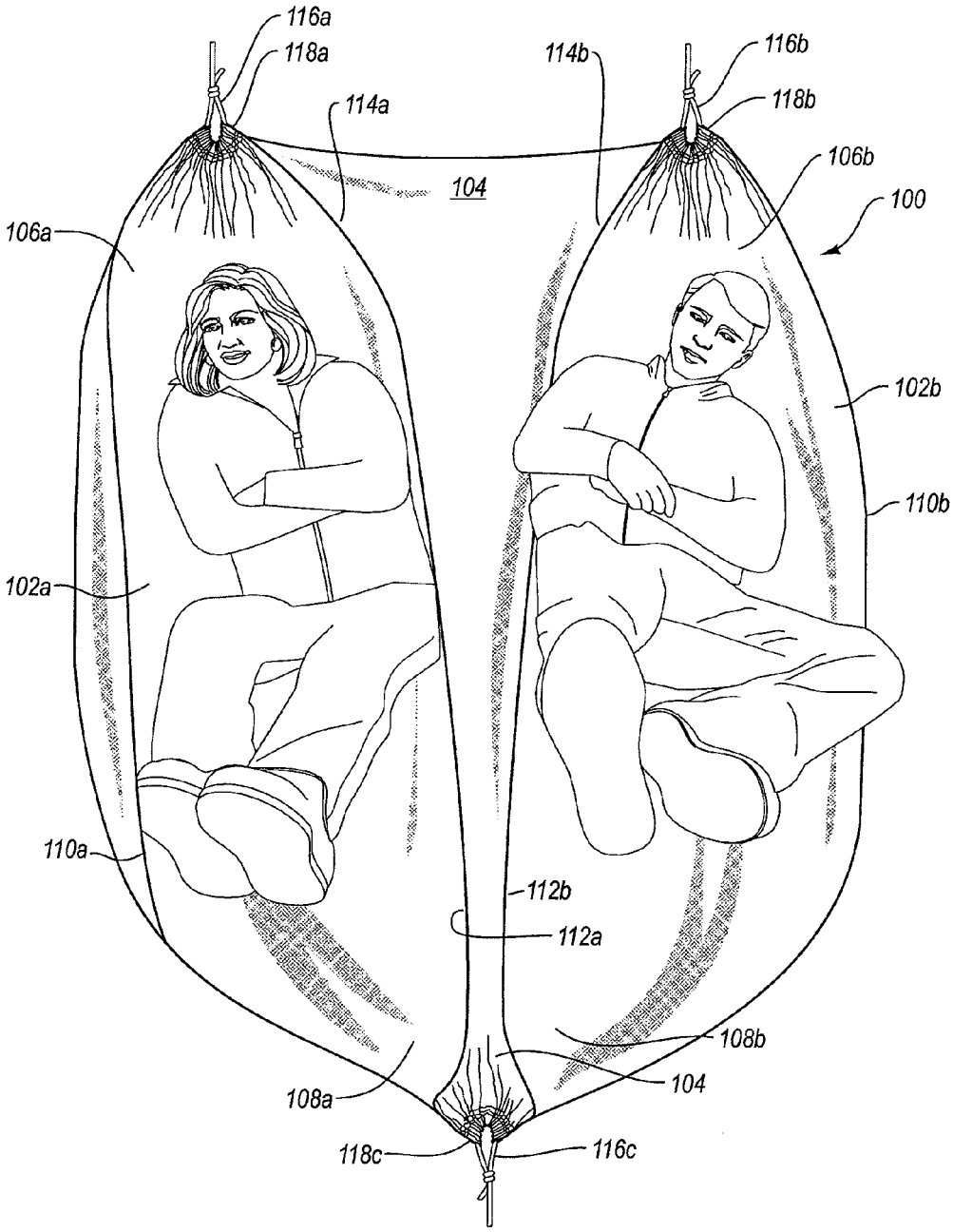
FIG. 4 illustrates the two-person hammock of FIG. 1 with one person each occupying a hammock base.

For example, as shown in FIG. 2, a single user may occupy one of the hammock bases (e.g., base 102*a*). It will be noted that the user is not "centered" within the hammock 100, but occupies one side of the hammock 100, and the hammock is stable, even with no occupant in hammock base 102*b*. As seen in FIG. 3, a second user may climb into the second hammock base 102*b* with substantially no disruption of the first occupant in first hammock base 102*a*. FIG. 4 shows the hammock 100 with an occupant in each side or compartment. Either or both users may move about freely within their hammock base without worry of disrupting the other occupant. For example, they may lean over the outer edge 110*a* or 110*b*, or even climb out without any substantial disruption of the other occupant.

Figure 5:
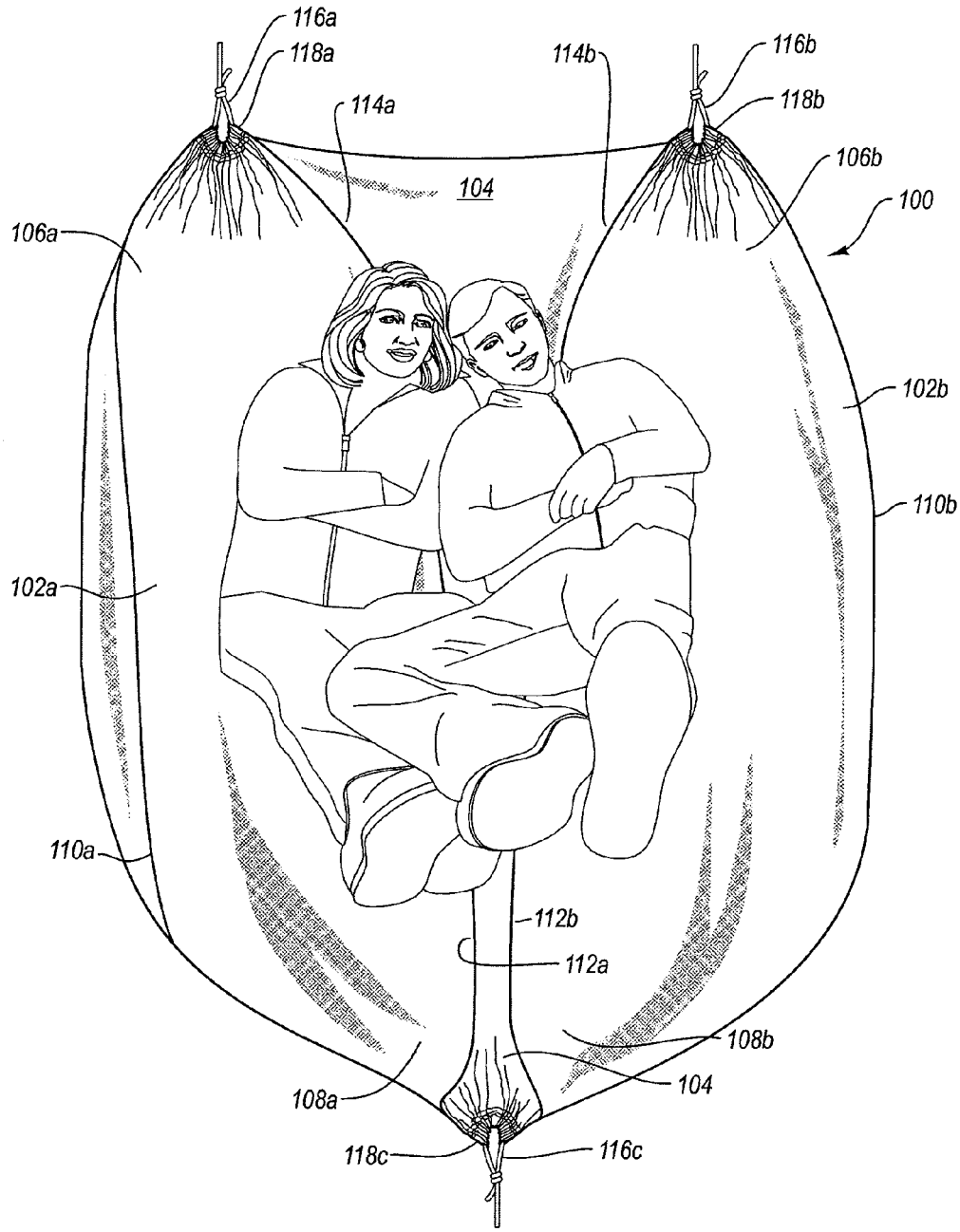
FIG. 5 illustrates how the two persons may move across the divider member towards one another.

For example, as seen in FIG. 5, both occupants may roll towards divider 104, causing the occupied portions of the hammock bases 102*a* and 102*b* and divider 104 to assume a more tensioned horizontal configuration as the hammock bases move laterally outward to cause the center of gravity of each individual to lay along a straight line between the support ropes of the occupied hammock base. This causes the inner edges of the hammock bases and the divider to stretch out under tension. Even when rolling towards one another (and divider 104), the hammock remains stable. There is no tendency for the heavier occupant to significantly upset the stability of the other occupant within such a configuration.

Figure 6:
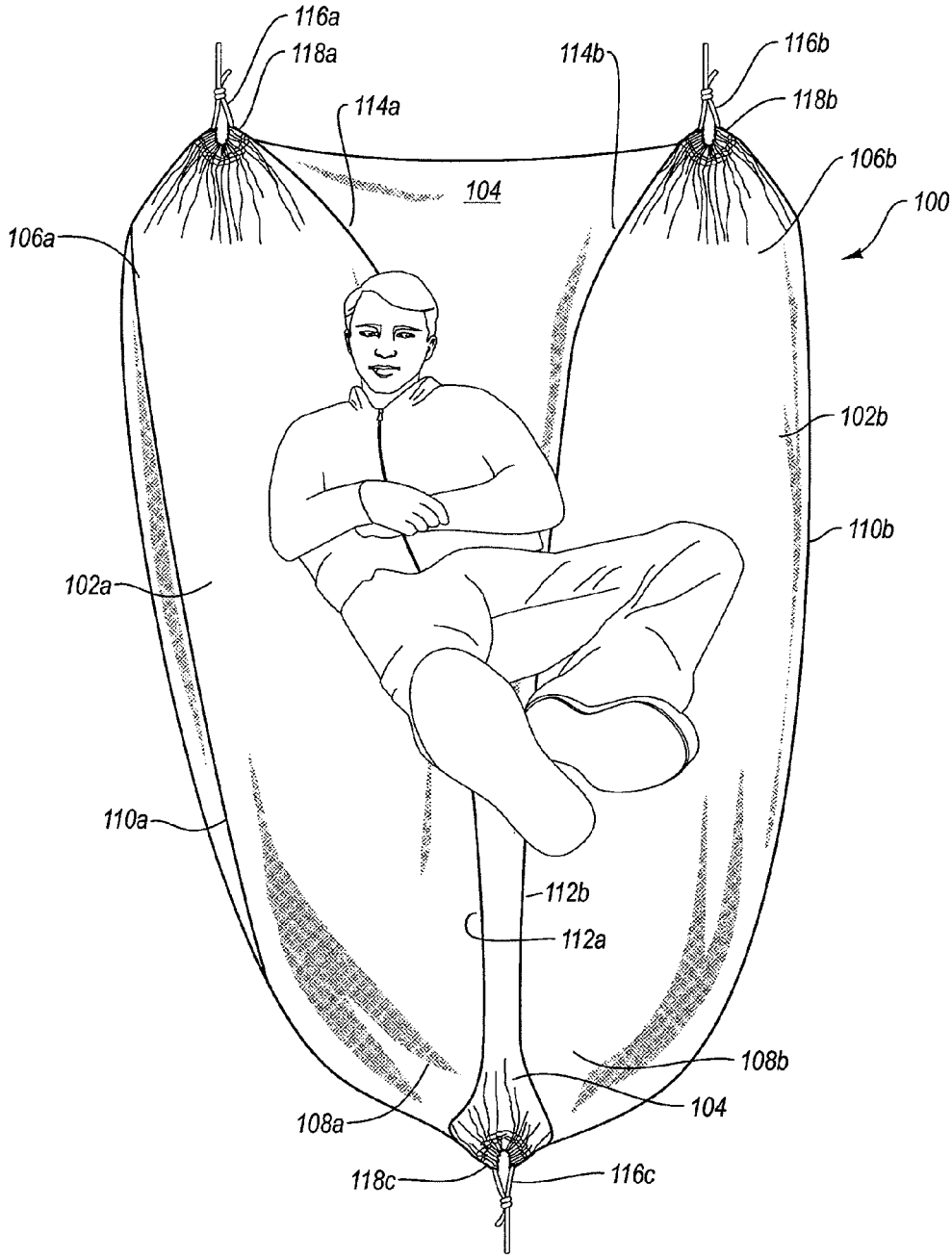
FIG. 6 illustrates a single person straddled diagonally over the divider member.

As seen in FIG. 6, because of the stability provided by the combination of the dual hammock bases 102*a* and 102*b*, the divider 104, and the rope support system, in an alternative use a single occupant may position himself diagonally with the central portion of his body over divider 104, which provides a nearly horizontal sleeping configuration as the hammock bases move laterally outward, and tension is applied to the divider and adjacent portions of the hammock bases 102*a*,

102*b*. Such a horizontal position is desirable for hammock users, as it simulates a flat bed. In another alternative use, the divider member 104 may provide space upon which a third small person (e.g., a child) may lie.

As seen in FIGS. 1-6 and FIG. 8, the divider 104 has its greatest width at the head end, adjacent the head sections 106*a* and 106*b* of bases 102*a* and 102*b*. The divider then tapers rather abruptly, and then gradually to provide a thinner central section before flaring again at the foot end adjacent the foot sections 108*a* and 108*b* of bases 102*a* and 102*b*. For example, the divider may have a maximum width at the head end between about 20 and about 60 inches, more preferably between about 35 and about 50 inches (e.g., about 45 inches). The divider at the foot end may have a maximum width between about 4 and about 15 inches, more preferably between about 6 and about 12 inches (e.g., about 8 inches). In addition, the divider provides storage space which can be shared by the individual occupants (e.g., storage pockets may be sewn or otherwise attached to the divider member).

The width of the central portion in the illustrated embodiment narrows relatively abruptly near the head end (e.g., to about half or less its maximum width near where an occupant's head may actually rest), and then continues tapering more gradually throughout the central portion so that the minimum width of the divider in the central portion is still maintained at a width between about 3 inches and about 6 inches. The inventor has found that maintaining such a minimum width of the divider (e.g., preferably at least about one inch, more preferably at least about 2 inches, most preferably at least about 3 inches) aids in maintaining the comfort of two simultaneous occupants. In addition, this provides for greater surface area for a single user to spread out if desired (e.g., See FIG. 6).

Figure 8:
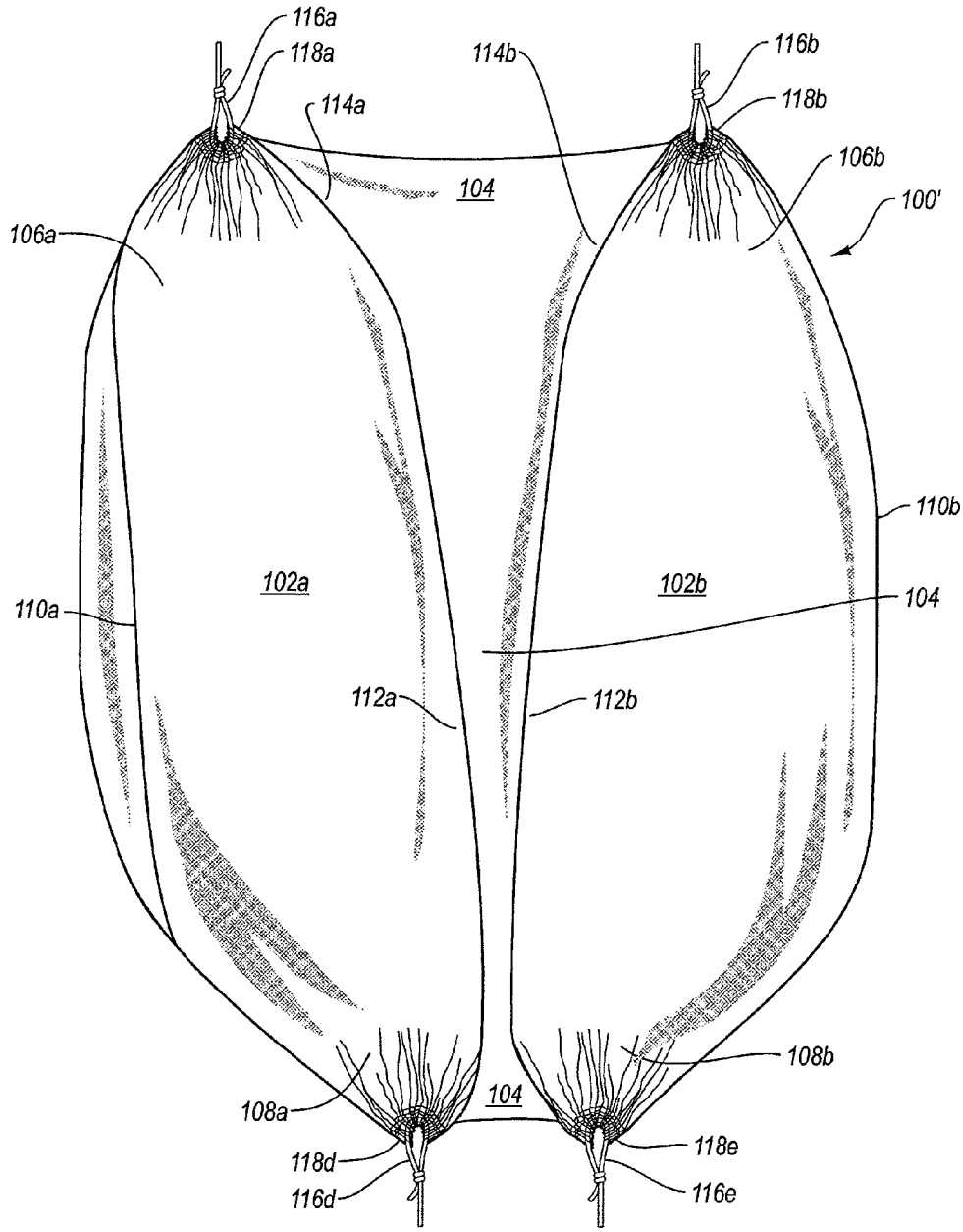
FIG. 8 is a perspective view of an alternative two-person hammock similar to FIG. 1, but including a four support rope configuration.
Figure 9:
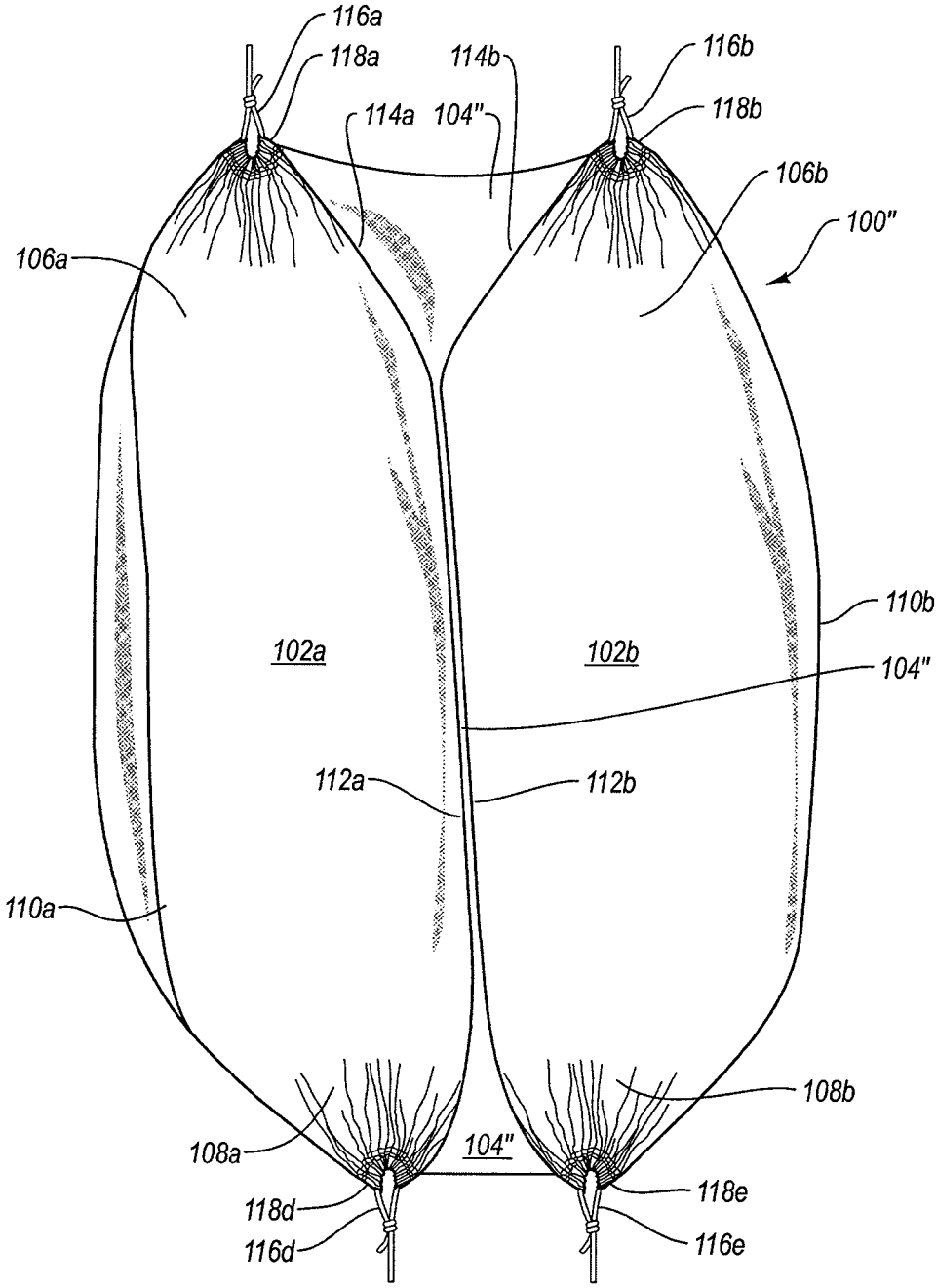
FIG. 9 is a perspective view of an alternative two-person hammock similar to FIG. 8, but including a divider member having a different configuration.

Although the divider is illustrated with a specific shape (e.g., a tapered wedge that flares somewhat at the foot end) in FIGS. 1-6 and 8, it is to be understood that the other shapes for the divider may be employed. One such example is illustrated in FIG. 9, described in further detail below. In addition, although not preferred, it may be possible in some embodiments for the divider to not be a single continuous piece, but rather along some length the central width may be 0 (i.e., the hammock bases contact one another directly), and the divider only separates at least the head section and preferably the foot sections of the hammock bases. Although such an embodiment may be less preferred because of the tendency of the occupants to bump into one another, it is within the scope of the present invention.

Figure 7:
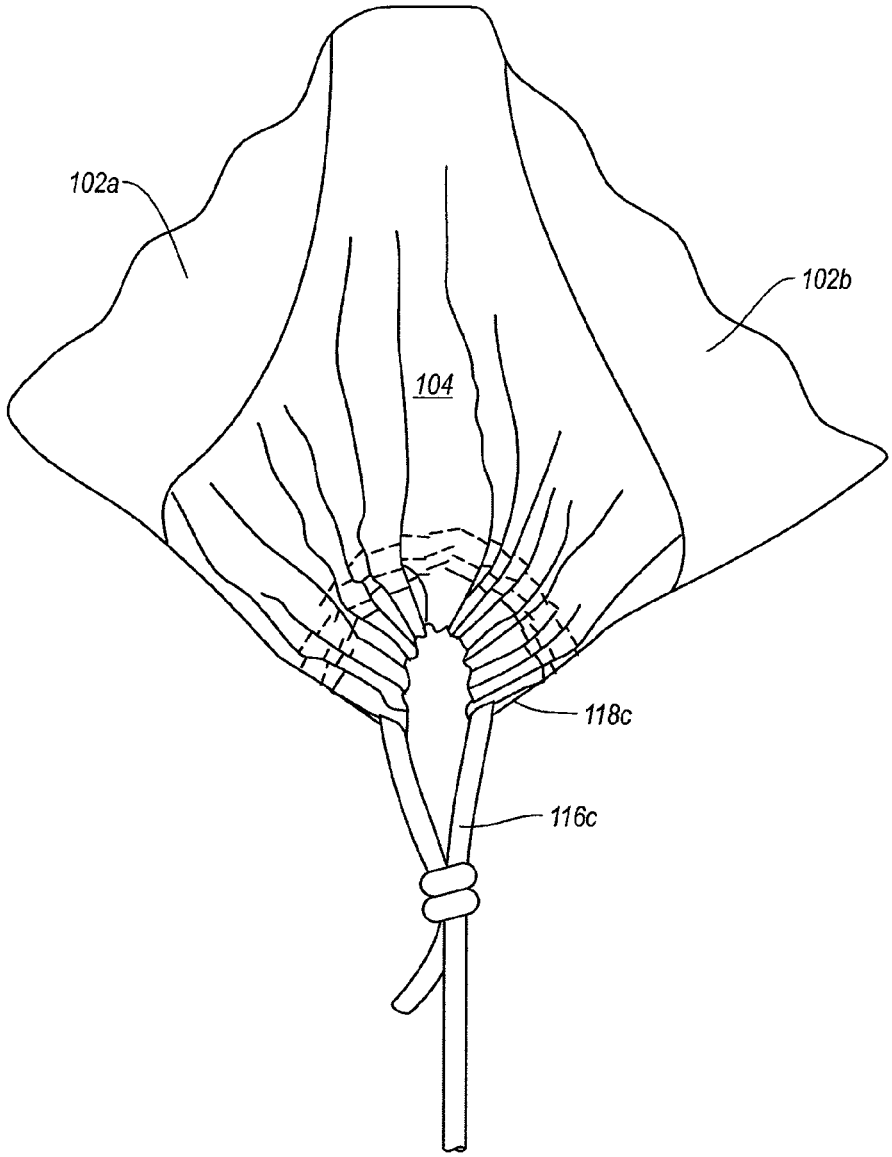
FIG. 7 is a close up view of the single rope attachment at the foot end of the two-person hammock of FIG. 1.

As perhaps best seen in FIG. 7, which illustrates sleeve 118*c* and rope 116*c* in close up, each sleeve is large enough in diameter to easily slide along the attached rope inserted through each respective sleeve. When weight is applied to one or both of the hammock bases, each sleeve associated with the weighted hammock base gathers or cinches up (as illustrated) to provide an extremely strong connection between the rope and the fabric sleeve of the hammock base. Other gathered fabric connection mechanisms will be apparent to one skilled in the art. Such configurations advantageously enable the hammock to be very lightweight and less complex. It also provides great stability to each hammock base 102*a*, 102*b* and the overall hammock 100, since neither hammock base will tip or roll over during use, as described in conjunction with the Figures above.

The fabric is gathered at the head and foot ends to provide an extremely strong connection between the ropes 116*a*, 116*b*, and 116*c* and the fabric of the hammock bases 102*a*, 102*b* and/or divider 104. When weight is applied to the edge of a hammock base (e.g., by a person sitting on the outer edge 110*a* or 110*b*) the hammock 100 is able to move to align itself by forming a direct line between the two support ropes at opposite ends through the applied weight (i.e., the center of gravity) so as to maintain stability. Because each hammock base includes two oppositely disposed support ropes, each base can adjust independently to maintain stability.

This design makes it possible for one to sit on the edge 110*a* or 110*b* of the hammock, take off footgear and place them on the ground or in pockets mounted to the underside of the hammock base (see FIG. 11) while leaning over the edge 110*a* or 110*b*. After leaning over outer edge 110*a* or 110*b*, the occupant may then turn and slide into the hammock without any need to support themselves with a foot or hand touching the ground. Additional details of the illustrated gathered fabric sleeve and rope support configuration are described in applicant's earlier U.S. Pat. No. 5,913,772, herein incorporated by reference.

Support ropes are attached to the hammock base where fabric is gathered at the head and foot ends to provide an extremely strong connection between the rope and fabric of the hammock base. If weight is applied to the edge of a hammock base (e.g., by a person sitting on the outer edge) the hammock is able to move to align itself by forming a direct line between the two support ropes at opposite ends through the applied weight (i.e., the center of gravity). This design provides a single rope (rather than multiple ropes) associated with a given hammock base for each end, providing great stability. In a three rope system a single foot end rope may be shared by both hammock bases.

Although illustrated with a three-rope configuration, other configurations may be possible. For example, a four-rope configuration is illustrated in FIG. 8. Double hammock 100' of FIG. 8 includes a rope and gathered fabric connection configuration in which each foot end of hammock bases 102*a* and 102*b* include a separate connection (i.e., 118*d* and 118*e*) and rope (i.e., 116*d* and 116*e*), respectively, much like the head ends of the embodiment of FIGS. 1-6. In either configuration, the gathered fabric (e.g., a sleeve) and rope configuration provides for steady support of the hammock base no matter the position of the user, and each hammock base is able to operate independently in a stable manner regardless of the status of the adjoining hammock base.

FIG. 9 illustrates a hammock 100" similar to the hammock 100' of FIG. 8, but with a divider member 104" having a different configuration. The divider 104" similarly has its greatest width at the head end adjacent head sections 106*a* and 106*b* of bases 102*a* and 102*b*. Rather than a wedge shape though, the divider tapers even more abruptly to a very narrow central portion before flaring again to an intermediate width at the foot end adjacent the foot sections 108*a* and 108*b* of bases 102*a* and 102*b*. For example, the divider may have a maximum width at the head end between about 20 and about 60 inches, more preferably between about 35 and about 50 inches (e.g., about 45 inches), with the foot end of the divider having a maximum width between about 6 and about 20 inches, more preferably between about 10 and about 15 inches (e.g. about 12 inches). The width of the central portion is the narrowest of all, for example between about 0.5 and about 3 inches (e.g., about 1 inch). Such a divider having an hourglass shape is less preferred relative to the wedge shape of FIGS. 1-6 because the narrow width of the divider in the central portion may not be sufficient to provide optimal comfort to two occupants.

Figure 10:
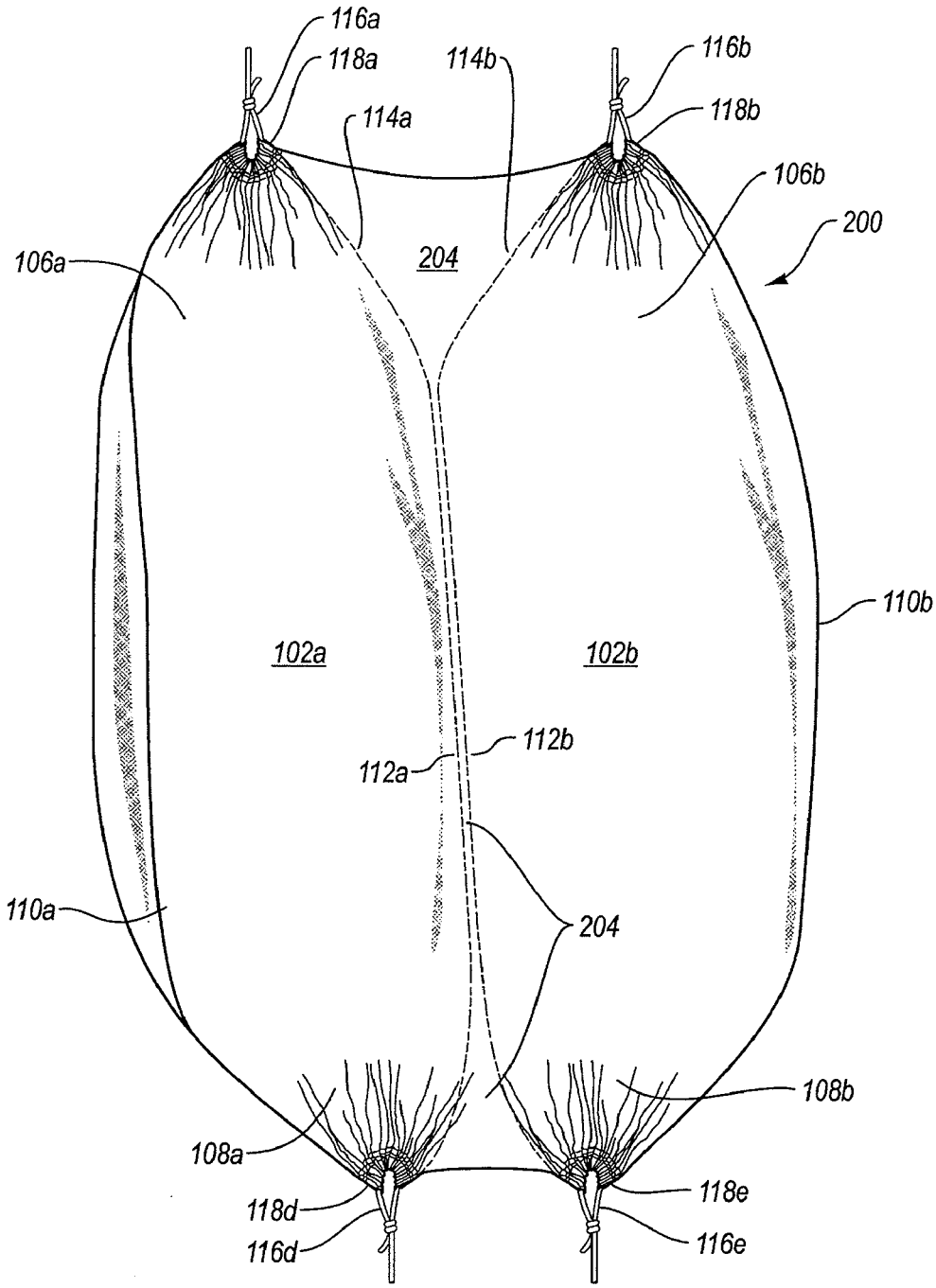
FIG. 10 is a perspective view of an alternative two-person hammock similar to FIG. 9, but in which the hammock bases and divider comprise a single integral piece with no seams.

As seen in FIG. 10, it is not necessary that the divider comprise a separate piece of fabric material which is then attached to the hammock bases. In the alternative of FIG. 10, the hammock 200 may simply comprise a single piece of material having the shape of the two hammock bases 102*a*, 102*b*, and a divider 104 (i.e., without any seams connecting hammock bases 102*a* and 102*b* to divider member 104). When a user climbs into the hammock, the portion of fabric material between the two hammock bases 102*a* and 102*b* acts as a divider member, just as if the hammock 200 were formed by stitching together separate hammock bases and a divider between them. As such, the outer limits of the "divider" 204 of hammock 200 are shown in phantom in FIG. 10.

The hammock bases and divider may be formed of a flexible fabric material (e.g., nylon). Advantageously, the hammock 100 can be rolled into a small, lightweight package. For example, when made of 1.2 oz. ripstop nylon and/or 3.2 oz. denim nylon the hammock may be rolled into a package of less than 8 inches by 15 inches. No poles, stakes, bars or stays of any kind are needed.

Figure 11:
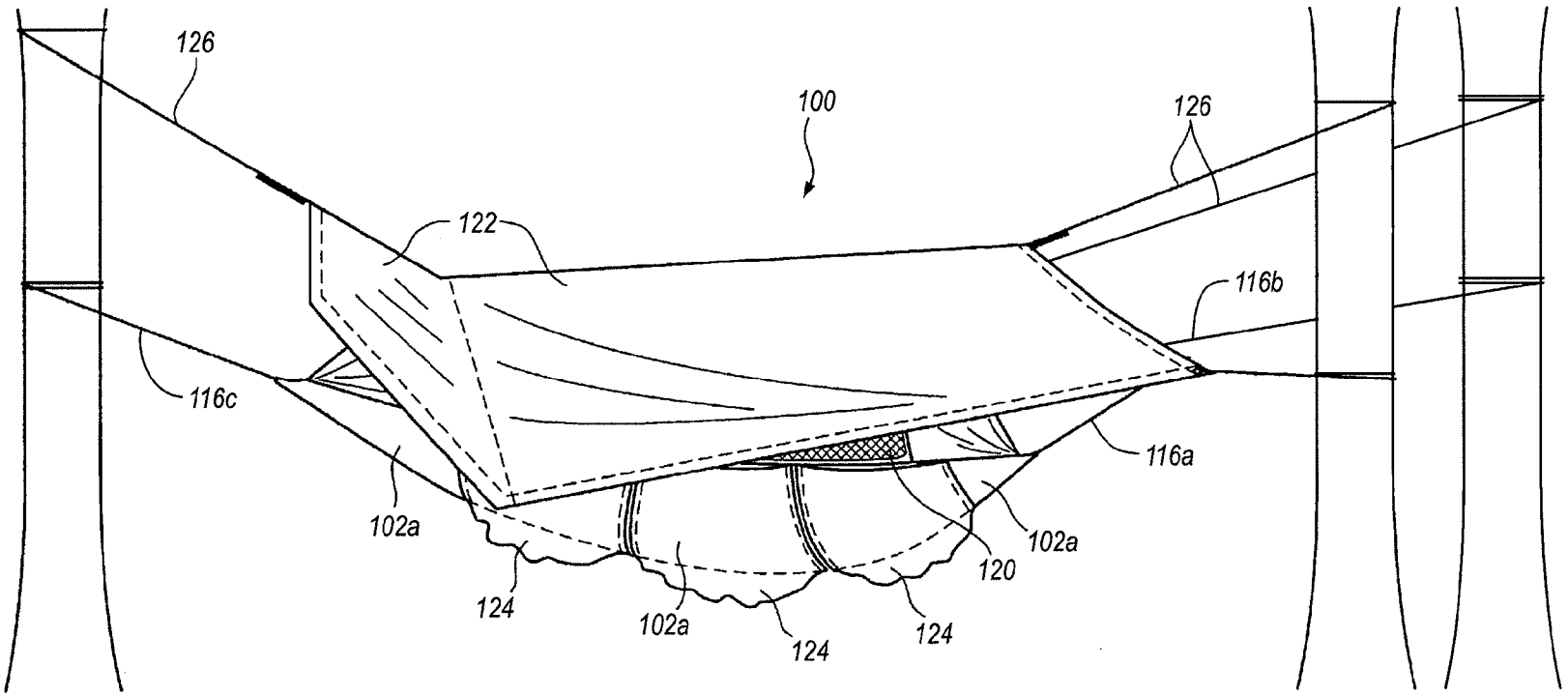
FIG. 11 is a side view of the two-person hammock of FIG. 1 including associated netting and a rain-fly.

FIG. 11 illustrates the double hammock 100 supported between two upright trees at the head end, and a single tree at the foot end. With a very large diameter tree at the head end, it may be possible to attach both head end ropes 116*a* and 116*b* to a single tree while still maintaining a desired degree of tension (and thus separation) within the head section of divider 104. This illustrates one possible advantage of a three-rope support system over a four-rope system, as the foot end rope may be more easily supported on a single upright tree (although it would still be possible to attach both foot end ropes of a four-rope system to a single tree at the foot end because of the relatively narrow width of divider 104 at the foot end). Hammock 100 is also illustrated with associated netting 120, rain-fly 122 and storage pockets 124. The preferably large pockets 124 placed underneath the hammock bases 102*a* and 102*b* provide room for all gear, food and supplies to be stored above ground. These pockets 124 not only keep gear off the ground where water or insects can get to it, but they also keep gear close by and within easy reach of the occupants in the hammock. Another important function provided by the pockets 124, is a nearly dead air space to the underside of the hammock bases 102*a*, 102*b* which helps to insulate the underside of the hammock bases.

Rain-fly 122, which covers the hammock bases 102*a* and 102*b* may be tapered and sewn down at the foot end of the hammock bases 102*a*, 102*b* so as to protect the occupant against water or wind penetrating through the foot end. The head end of the double hammock 100 is within easy reach of an occupant of the hammock, and fly 122 can be pulled down around hammock 100 in bad weather or may alternatively be or left up (e.g., on a warm, clear night). All fabrics are preferably water repellant and/or water sealed. The hammock 100 of FIG. 7 may be netted on both the right and left lateral sides, and may be zippered on both lateral sides for ease of entry. The zippers may curve up at the head and foot ends to give maximum opening of the netting 120. The ability to enter the hammock from either side is advantageous depending on where the hammock is set up in wilderness locations.

The storage pockets 124 cover the substantially the full width of the bottom of hammock bases 102*a*, 102*b*. Elastic or other closures may be included to pull the storage pockets 124 closed, helping to provide a near dead-air space between the hammock bases and to also provide for billowing of the pocket fabric while still holding the mouth of the pocket substantially closed. The insulation effect is enhanced when items such as clothing and other equipment are placed in the pockets, which also helps to retain a billowed or "full" shape of the pockets 124. Pockets 124 are large enough to hold almost anything a camper or back packer may carry. Pockets 124 keep equipment, food and personal items off the damp ground, protected from insects or other animals and within easy reach of the occupants of the double hammock.

The netting 120 and rain-fly 122 are attached by rope 126 to the same trees or uprights used to support the hammock bases by rope 126, but are independent of the hammock bases 102*a* and 102*b*, and do not contribute in any way to the stability or weight bearing functions of the hammock bases. Additional details the netting, rain-fly, and pockets are described in applicant's earlier U.S. Pat. No. 5,913,772, already incorporated by reference.

It will be appreciated that the present claimed invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. A system comprising:

a structure comprising three anchors substantially rigidly fixed with respect to one another;

three tethers, each tether of the three tethers suspended from a different anchor of the three anchors;

a first hammock having first and second ends spaced from one another along a first longitudinal axis and defining a first concavity extending from proximate the first end of the first hammock to proximate the second end thereof, the first end thereof suspended from a first tether of the three tethers, the second end thereof suspended from a second tether of the three tethers;

a second hammock having first and second ends spaced from one another along a second longitudinal axis and defining a second concavity extending from proximate the first end of the second hammock to proximate the second end thereof, the first end thereof suspended from the first tether, the second end thereof suspended from a third tether of the three tethers;

the first and second hammocks positioned with respect to one another such that the first and second longitudinal axes converge proximate the first tether; and a buffer comprising flexible fabric extending laterally to connect the first and second hammocks.

2. The system of claim 1, wherein the three anchors are positioned to be nonlinear with respect to one another.

3. The system of claim 2, wherein the structure comprises a geologic environment comprising a plurality of trees.

4. The system of claim 3, wherein each anchor of the three anchors comprises a tree trunk corresponding to a different tree of the plurality of trees.

5. The system of claim 1, wherein:

the first hammock comprises an interior edge extending from the first end of the first hammock to the second end thereof, the interior edge located adjacent the second hammock;

the second hammock comprises an interior edge extending from the first end of the second hammock to the second end thereof, the interior edge located adjacent the first hammock;

the buffer connects to the first hammock substantially continuously along the interior edge thereof; and the buffer connects to the second hammock substantially continuously along the interior edge thereof.

6. The system of claim 5, further comprising a barrier comprising netting, the barrier cooperating with the first hammock, second hammock, and buffer to form an enclosure having a top and a bottom.

7. The system of claim 6, wherein the first hammock, second hammock, and buffer form the bottom of the enclosure and the barrier forms the top of the enclosure.

8. The system of claim 1, further comprising a first load applied substantially exclusively to the first hammock and a second load applied substantially exclusively to the second hammock.

9. The system of claim 8, wherein:

the three anchors comprise a first anchor supporting the first tether, a second anchor supporting the second tether, and a third anchor supporting the third tether;

the first and second anchors support substantially all of the first load; and the first and third anchors support substantially all of the second load.

10. The system of claim 1, wherein the first tether comprises a first rope and a second rope, the first rope extending to engage the first end of the first hammock, the second rope extending to engage the first end of the second hammock.

11. A system comprising:

a structure comprising three anchors substantially rigidly fixed with respect to one another;

a first hammock having first and second ends spaced longitudinally from one another and defining a first concavity extending longitudinally from proximate the first end of the first hammock to proximate the second end thereof, the first end thereof suspending from a first anchor of the three anchors, the second end thereof suspending from a second anchor of the three anchors;

a second hammock having first and second ends spaced longitudinally from one another and defining a second concavity extending longitudinally from proximate the first end of the second hammock to proximate the second end thereof, the first end thereof suspending from the first anchor, the second end thereof suspending from a third anchor of the three anchors;

a buffer extending longitudinally and laterally to connect the first hammock to the second hammock, the buffer having first and second ends spaced longitudinally from one another, a first lateral width at the first end, and a second lateral width at the second end, the second lateral width being substantially greater than the first lateral width to promote the comfort of simultaneous users of the first and second hammocks.

12. A method comprising:

selecting three anchors substantially rigidly fixed with respect to one another;

selecting a hammock system comprising a first hammock having first and second ends spaced from one another along a first longitudinal axis, a second hammock having first and second ends spaced from one another along a second longitudinal axis, and a buffer extending laterally to connect the first and second hammocks;

deploying the hammock system to an installed configuration wherein the first hammock hangs with slack between and from a first anchor of the three anchors and a second anchor of the three anchors, the second hammock hangs with slack between and from the first anchor and a third anchor of the three anchors, and the first and second hammocks are positioned with respect to one another such that the first and second longitudinal axes converge proximate the first anchor; and entering, by a first user after the deploying, the first hammock without previously removing the slack therein.

13. The method of claim 12, wherein the three anchors are positioned to be nonlinear with respect to one another.

14. The method of claim 13, wherein each anchor of the three anchors comprises a tree trunk corresponding to a different tree.

15. The method of claim 12, wherein:

the first hammock comprises an interior edge extending from the first end of the first hammock to the second end thereof, the interior edge located adjacent the second hammock;

the second hammock comprises an interior edge extending from the first end of the second hammock to the second end thereof, the interior edge located adjacent the first hammock;

the buffer connects to the first hammock substantially continuously along the interior edge thereof; and the buffer connects to the second hammock substantially continuously along the interior edge thereof.

16. The method of claim 15, wherein the hammock system further comprises a barrier comprising netting, the barrier cooperating with the first hammock, second hammock, and buffer to form an enclosure having a top and a bottom.

17. The method of claim 16, wherein the hammock system is configured such that the first hammock, second hammock, and buffer form the bottom of the enclosure and the barrier forms the top of the enclosure.

18. The method of claim 12, further comprising entering, by a second user after the deploying, the second hammock without previously removing the slack therein.

19. The method of claim 18, further comprising:

supporting by the first and second anchors substantially all of the weight of the first user; and supporting by the first and third anchors substantially all of the weight of the second user.

20. The method of claim 18, further comprising exiting, by the second user while the first hammock is occupied by the first user, the second hammock without inducing movement in the first hammock.

* * * * *